US005092457A

United States Patent [19]

Islava et al.

[11] Patent Number: 5,092,457

[45] Date of Patent: Mar. 3, 1992

[54] ENGINE OIL CHANGE KIT

[76] Inventors: Steve Islava, P.O. Box 2417, Newport Beach, Calif. 92663; J. Guy Cazort, 511 Seaward, Corona Del Mar, Calif. 92625

[21] Appl. No.: 563,595

[22] Filed: Aug. 6, 1990

[51] Int. Cl.[5] ..... B65D 81/36

[52] U.S. Cl. ..... 206/223; 141/98; 184/1.5; 184/106; 229/138

[58] Field of Search ..... 141/98, 337, 338; 184/1.5, 106; 206/223; 220/573, 418; 229/138

[56] References Cited

U.S. PATENT DOCUMENTS

| | | | |
|---|---|---|---|
| 2,737,335 | 3/1956 | Moore | 220/419 |
| 2,917,221 | 12/1959 | Risdon | 229/138 |
| 3,067,923 | 12/1962 | Thiets | 220/418 |
| 4,053,102 | 10/1977 | Stark | 220/418 |
| 4,064,969 | 12/1977 | Black | 184/106 |
| 4,098,398 | 7/1978 | Meyers | 206/223 |
| 4,442,936 | 4/1984 | Densham | 206/223 |
| 4,442,970 | 4/1984 | Farber | 229/138 |
| 4,813,548 | 3/1989 | Wyberg | 229/138 |
| 4,856,652 | 8/1989 | Bowland | 184/106 |
| 4,895,250 | 1/1990 | Schifrin | 206/223 |

FOREIGN PATENT DOCUMENTS

| | | | |
|---|---|---|---|
| 0673879 | 11/1963 | Canada | 220/418 |

*Primary Examiner*—Jimmy G. Foster
*Attorney, Agent, or Firm*—Wagner & Middlebrook

[57] ABSTRACT

An oil change kit including an oil impervious box dimensioned to hold a container or containers constituting the quantity of oil for a single engine oil change, e.g. 5 quarts. The box includes a top closure which is contiguous with the side and end walls and is foldable into three different conditions, 1) to display part of the oil container or containers, 2) to define a funnel-like opening for receiving waste oil and 3) foldable to seal the box with waste oil ready for disposal. Accessories contained in the kit and stored in the volume not taken up by the new motor oil containers is a wipeup cloth, a pair of disposable gloves and a universal wrench.

12 Claims, 2 Drawing Sheets

FIG. 5
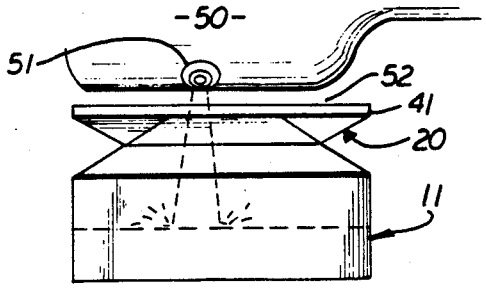
FIG. 6
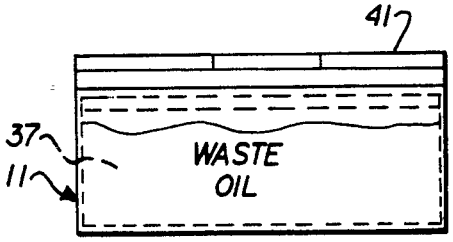
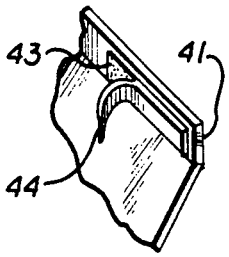
FIG. 6A
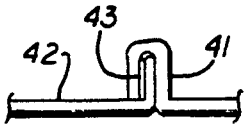
FIG. 6B
FIG. 7
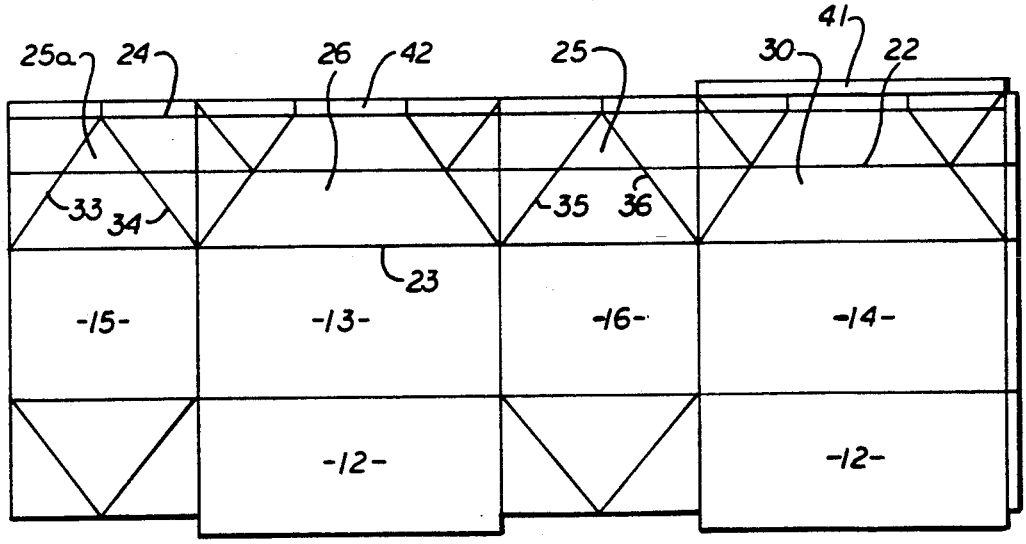

ENGINE OIL CHANGE KIT

BACKGROUND OF THE INVENTION

Attempts have been made in the past to develop oil change kits for use by "do it yourself" automobile owners. Examples of patented devices that aid in changing oil are disclosed in the following patents:

U.S. Pat. No. 4,301,841 MULTIPURPOSE CONTAINER, K. Sandow Nov. 24, 1981

A hollow plastic container designed to lie on its side and have a funnel like side and a funnel opening to allow waste motor oil to enter the container. A second sealable opening on one end is used to drain the oil. The container is reusable.

U.S. Pat. No. 4,513,865 DISPOSABLE OIL DRAIN PAN AND CONTAINER COMBINATION, Melzi et al., Apr. 30, 1985

A multiple container for receiving waste motor oil including a large side opening plus a restricted opening.

U.S. Pat. No. 4,524,866 MOTOR OIL CATCH PAN AND MOTOR OIL CHANGE KIT INCORPORATING THE SAME, P. J. Poloacco, June 25, 1985

An oil catch pan which is configured to hold a multi-quart container of oil. The oil catch pan includes a fitting matching the multi-quart container to allow draining of captured waste oil back into the now empty container.

U.S. Pat. No. 4,930,602 OIL DRAIN SYSTEM, K. K. Gust, June 5, 1990

An oil drain system having a rectangular box designed to hold multiple containers of oil and a double funnel for directing waste oil into the multiple containers.

U.S. Pat. No. 4,756,411 MARKETING SYSTEM FOR APPARATUS FOR CHANGING ENGINE OIL, E. D. Garland, July 12, 1988

A combined package for holding containers of fresh oil with an integral receptor for receiving waste oil. A removable plug is present for closing the drain opening. An oil filter support is included.

U.S. Pat. No. 4,632,268 DISPOSABLE OIL DRAIN PAN AND CONTAINER COMBINATION, Melzi et al., Dec. 30, 1986

A plastic container having a drained oil receiving opening on one face which is concave and funnel-like and a discharge opening on the top wall.

U.S. Pat. No. 4,557,395 PORTABLE CONTAINER WITH INTERLOCKING FUNNEL, V. A. DeLay, Jr., Dec. 10, 1985

A container useful for collecting waste motor oil including a funnel in a major face.

U.S. Pat. No. 4,533,042 MOTOR OIL CHANGE KIT AND CATCH PAN FOR USE IN CHANGING AUTOMOTIVE MOTOR OIL, W. F. Pollacco, Aug. 6, 1985

A do it yourself catch pan for collecting waste motor oil including a bottom drain for emptying the pan into the emptied fresh oil container.

U.S. Pat. No. 4,153,155 FLUID COLLECTOR AND MULTI PACKAGE SYSTEM, E. L.. Bean, May 8, 1979

A package for multiple containers of oil cans and a flexible plastic bag for receiving waste oil.

In each of the foregoing oil drain kits, the kit itself is relatively expensive even though reusable. Where it is designed as a marketing tool it has sufficient additional volume that it may involve inefficient use of shelf space. Therefore, there remains the need for a low cost effective system which effectively displays a particular brand of oil and allows its transported storage and stacking without any unusual space requirements. Additionally, there is a need for one which is easily transported by the purchaser, easily opened and easily used to capture waste oil and easily transported for disposal of the waste oil.

BRIEF DESCRIPTION OF THE INVENTION

Faced with the foregoing state of the art, we have conceived a simple plastic lined paper board container which is regular in shape and effectively displays motor oil in an appropriate quantity for an oil change, for example, 5 quarts. The container is basically a box, rectangular in shape, having a large flat side as the bottom, having a side wall usable as the bottom during shelf storage to display the oil containers and the large bottom surface used to rest on the surface below an automobile while the crank case is drained. The four walls, two side and end walls have a sufficient height to receive a number, for example, 5 containers of fresh oil stored on edge. The top closure is continuous and foldably secured to the sides and ends of the box. The top closure is sufficient size to provide overlap and sealing of the interior of the box for waste oil disposal and is foldable to define an edge splash shield approximating the box dimensions. The edges defining the splash shield are flexible to the extent necessary to allow the user's hand and wrench to enter the closure portion and remove the engine drain plug with substantially good splash protection. The top closure portion includes sealing means such as adhesive tape having a protective cover thereon. After the waste oil has filled the box, removal of the protective layer on the sealing tape allows the top closure to be folded closed and taped sealed. The box is then ready for disposal through appropriate collection agencies.

Contained within the kit as marketed optionally, are a clean cloth for wiping down any residual oil on the drain plug and oil pan to prevent drippage, a pair of disposable gloves and a drain plug wrench.

BRIEF DESCRIPTION OF THE DRAWINGS

This invention may be more clearly understood from the following detailed description and by reference to the drawing in which:

FIG. 5 shows the container of this invention below an engine in the process of being filled with waste oil;

FIG. 6 is a side elevational view of the container of this invention filled with waste oil ready for disposal;

FIGS. 6A and B are fragmentary detail views of the sealing feature of this invention;

FIG. 7 is a front face view of the container blank made of plastic protective paperboard.

DETAILED DESCRIPTION OF THE INVENTION

In order to meet the real world requirements for "do it yourself" motor oil changers, any kit must meet the needs of the oil refiner or packager, the retailer and the do-it-yourself oil changer. The kit must effectively package new motor oil in single engine change quantities and be handlable with conventional packaging machinery. It must take no significantly greater storage space than the oil containers in both storage and on display in a retail establishment. If it can show the oil in its container to retail customers that is also desirable.

Of principal importance is the requirement that it not add significantly to the cost to the refiner or packager, the retailer and also to the "do-it-yourselfer" who, by definition, is cost conscious. The kit makes his oil changing convenient and still does not cost any more or only slightly more than the required oil change quantity of containers, itself.

In the oil changing process, it would be desirable that immediately upon opening the kit and removal of the fresh oil that the waste oil receiver is ready to receive the waste oil with a minimum of splashing and, most important, after receiving the waste oil, there is no further handling of the oil by the "do-it-yourselfer", no decanting to another container, no cleanup of oil on the exterior of the receiver and no caps or plugs to become lost or leak.

Figure 1:
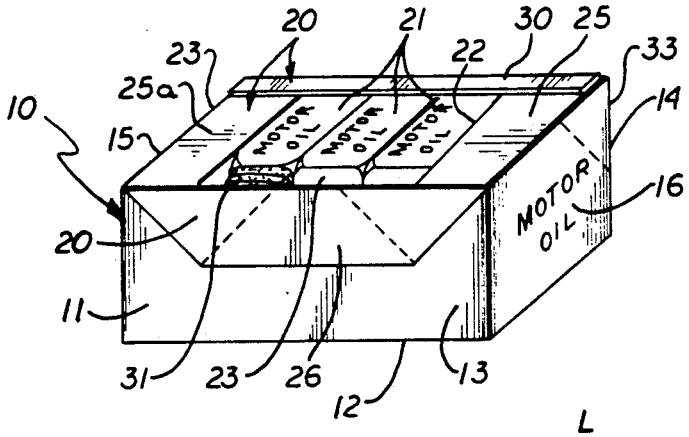
FIG. 1 is a perspective view of the container of this intention as it appears in the retail store filled with fresh oil with three of the five oil containers visible through the partially opened top.
Figure 2:
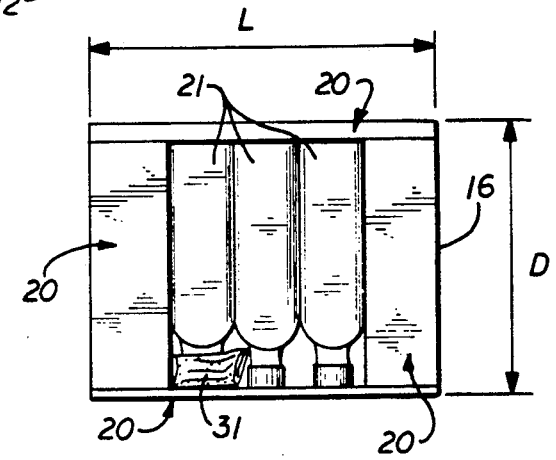
FIG. 2 is a top plan view thereof as it appears in the retail establishment.
Figure 3:
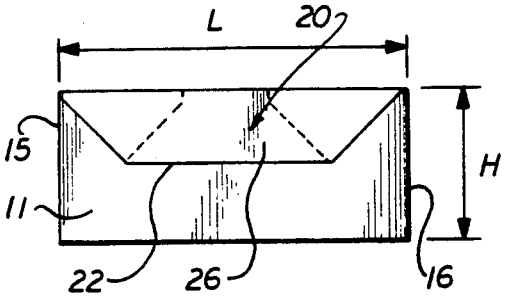
FIG. 3 is a front elevational view thereof.

Each of these requirements are met by this invention, best illustrated in the drawings, FIGS. 1–7 to which reference is now made. In FIG. 1 a completed motor oil merchandising and waste oil receiver kit 10 is illustrated. It comprises a rectangular box-like package 11 having a bottom 12, a pair of side walls 13 and 14, a pair of end walls 15 and 16 and a top closure, generally designated 20. The box 11 is dimensioned to receive a plurality of individual quart quantity motor oil containers 21 or a single container providing sufficient oil for a single automobile motor oil change, e. g. 5 U.S. quarts. In FIG. 1, three of the five quart containers are visible through the top opening to allow viewing of the product. The entire kit may be covered, optionally, with a transparent cover such as shrink wrapped plastic to hold the individual motor oil containers in place and to hold the top covering in its folded state as shown in FIGS. 1–3.

The top closing 20 may be seen in FIGS. 1–3 as being a continuation of the side walls 13 and 14 and end walls 15 and 16 of the box 11 and are folded with an intermediate fold line 22 between the fold line 23 at the top of the box body and the top fold lines 24 of the top closing 20 (see FIG. 7). The intermediate fold line 22 which is continuous around the entire top closing 20 allows the top closing 20 to be folded into three different configurations for the three different stages of use.

The first fold arrangement is illustrated in FIGS. 1–3 in which the top closing 20 is folded to partially enclose the top of the box 11. End flap portions **25*a* and 25 of the top opening 20 are folded double and overly the end regions of the top opening and, in this arrangement cover the two outermost containers of motor oil. The side flaps 26 and 30 are folded downward and overly the side walls 13 and 14 of the box 11 as best seen in FIG. 3. This arrangement allows the kit to be displayed on a shelf or counter with the actual oil containers visible. Additional accessories such as a wipe cloth 31, disposable gloves 32 and a drain plug wrench 33 may be included in the kit 10 and contained within the box 11 in the available space between the necks of the motor oil containers 21 and the wall of the box 11**.

In FIGS. 1 and 2, the disposable wipe up cloth 31 is shown overlying the necks of bottles 21. If the kit 10 is covered with a transparent cover such as shrink wrapped plastic, the cover will retain the accessories within the box 11 without any danger of loss or pilferage. Typical accessories are shown in FIG. 4.

Figure 4:
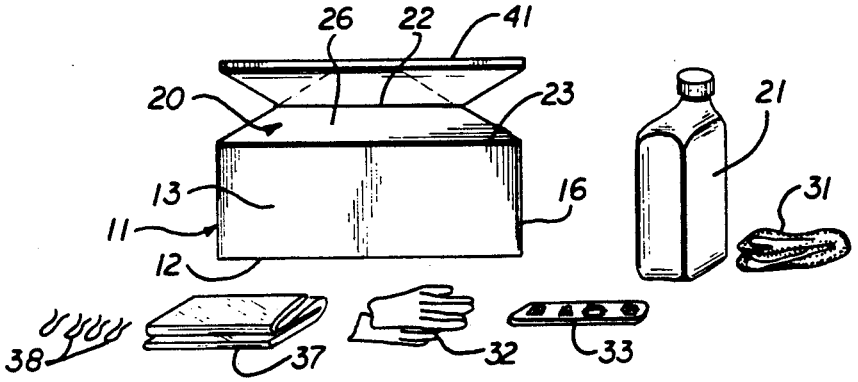
FIG. 4 is a side elevational view of the container of FIG. 1 with the fresh oil containers removed with one of which appears beside the open container along with accessories such as the oil wipe up rag, disposable gloves and wrench.

Referring now to FIG. 4, the kit 10 may be seen with the new motor oil containers 21 removed and one of them standing beside the box 11. Also shown are a wipeup cloth 31, a pair of disposable gloves 32 and a universal crankcase plug wrench 33. These are examples of suitable accessories for the kit and all may be easily packaged within the box 11 and discarded after use.

Although the box 11, itself, is oil impervious, as a further insurance against leakage, a plastic bag 37, of size sufficient to hold the quantity of waste oil, e. g. 5 quarts, and to be sealed is included as an accessory. Such a bag may be of the type which is sold commercially under the trademark Ziplock is suitable for the purpose since the seal is not affected by oil. Such a bag 37 may be opened and placed in the box 11 after the containers 21 of fresh oil and the other accessories have been removed. Miniature plastic clips 38 may be used to secure the open top of the bag 37 to the edges of the top closure 20 during waste oil draining.

Note in FIG. 4 that the top closure 20 has been folded using the intermediate fold line 22 to a generally funnel like appearance and provides a splash shield nearly as large as the box 11 itself. There is little danger of splash of the oil during draining and particularly during the step of removal of the drain plug in which most spillage occurs. In fact, with the box 11 in place and the top closure 20 folded as shown in FIG. 4, its flexibility allows the do-it-yourselfer to insert his hand and wrench into the funnel region, slightly depressing the top closure 20 but basically keeping the splash shield in place. The user's face is also shielded from any splashing by the top closure since the do-it-yourselfer's hand and wrench will normally enter from the end.

Typically, the box 11 has body dimensions of 4¾ inches in height (H) by 8½ inches in depth (D) and 12½ inches in length (L) and with the top closure expanded as illustrated in FIG. 4, the overall height extends to 7 to 9½ inches. This is sufficient height, in certain motor vehicles, to partially enclose the lowest portions of the crankcase containing the drain plug. Splashing or spillage during waste oil drainage should be all but eliminated by this feature. The normal draining of an engine crankcase 50 through its drain hole 51 is illustrated in FIG. 5. In this figure, the box 11 is located on the ground or shop floor below the crankcase 50 but the large funnel-like opening 52 has a throat equal to the box 11 lateral dimensions (e. g. 8×12 inches thereby insuring that there is little possibility for splashing. This funnel-like opening is significantly larger than prior art funnels for do-it-yourself motor oil changing.

When the draining step is completed, the box is withdrawn from under the vehicle and immediately, (after retrieval of the drain plug if it happened to fall into the box 11) fold the top closure 20 by folding inwardly the end diagonal fold lines 33, 34, 35 and 36, depressing the panels 26 and 30 to close the top and bring the foldover longitudinal tab 41 and seal it to the matching tab 42 of the panel 26. Sealing is preferably accomplished by the presence of doublesided adhesive tape 43 which is already secured to the inside of tab 41 and protected by its cover strip 44. Removal of cover strip 44 exposes the adhesive which seals the inner side of tab 41 to the outer side of tab 42. The tabs 41 and 42 are best seen in FIGS. 6 A and 6 B. The tabs 41 and 42 then form a short ridge on the top of sealed box 11, as illustrated in FIG. 6 of insufficient height to be used as a handle thereby insuring that the box is carried for disposal by its bottom surface.

We have found that plastic coated paperboard is effective for the box 11. A polymer coated both side 1 mil paper bearing the designation 0.024 SBS PE 2 sides of the International Paper Company is the best material known to us at this time for this invention. The dimensions given above are illustrative for a typical kit employing commercially available one quart containers of motor oil for use in changing 5 quarts of oil. If an engine requires a larger or lesser quantity of oil, the kit may contain more or less fresh oil in a container or containers and the dimensions of the box 11 will change accordingly.

The foregoing constitutes an illustrative embodiment of this invention but is not to be considered to be limiting. It is recognized that one of skill in the art can produce embodiments which may appear somewhat different but do not depart from the spirit and concept of this invention. Therefore, this invention is defined by the following claims including the scope afforded by the doctrine of equivalents.

What is claimed is:

1. A package for the merchandizing of motor oil container and for effective capturing and transporting for disposal of used motor oil comprising:

a generally rectangular oil box dimensioned to receive a quantity of one or more motor oil containers;

said box including a bottom, side and end walls defining an oil impervious receiver of sufficient volume to receive and transport the used oil of a motor vehicle crank case when drained;

said box defining an opening on a top side thereof for receiving a stream of used motor oil as it is drained from an engine crank case with the box resting on its bottom surface;

said box including a top covering integral with said side and end walls joined to said side and end walls in a first continuous fold line, said top covering including a top continuous fold line, a second continuous fold line parallel to and intermediate between said top fold line and said first continuous fold line, and angled fold lines intersecting said second continuous fold line extending from said top continuous fold line to said first continuous fold line, said top covering being foldable in a first position to retain said containers for transport and sale;

said box being openable to allow the removal of the motor oil containers without disturbing the oil impervious nature of said receiver and foldable to close said used motor oil receiving opening; and means for sealing said box for transport to an oil recycling or disposal location.

2. A package in accordance with claim 1 wherein said top covering forms a continuous foldable extendable top opening extension of said side and end walls.

3. A package in accordance with claim 1 wherein said continuous intermediate fold line is foldable inwardly to allow said top covering to extend upward and inwardly from the sides of said receiver and act as a splash shield for used motor oil during drainage of used motor oil from an engine.

4. A package in accordance with claim 1 wherein said continuous intermediate fold line and said angled fold lines are foldable;

a) to allow said top covering to be folded to partially close said top opening while retaining the container or containers of new motor oil with a portion thereof exposed;

b) to allow said top covering to act as a splash shield for used motor oil during drainage of used motor oil from an engine; and c) to allow said top covering to be folded into closed condition for transport.

5. A package in accordance with claim 1 wherein;

said angled fold lines of said end walls meet at the center of said top fold lines of said end walls and at their opposite ends meet the angled fold lines of said side walls at a point along said fold lines connecting said top covering to said side walls to allow the ends of said top covering to fold;

the top covering constituting extensions of said side walls of said box having a total length greater than the end dimension of said package thereby allowing overlap of said top covering extensions of said side walls sufficient for sealing said package.

6. A package in accordance with claim 5 including sealing means secured to said top covering portion of said box for sealing said package when folded into used oil transport condition.

7. A package in accordance with claim 6 wherein said sealing means includes a removable oil impervious protection cover to be removed by the user after filling of the box with used motor oil.

8. An oil change kit comprising:

a) at least one container containing in total sufficient quantity of new motor oil for a single engine oil change;

b) said container presenting a generally rectangular shape;

c) a generally rectangular housing for said new motor oil container having a generally flat bottom as one of the largest surfaces thereof;

d) said rectangular housing having side and end walls and a contiguous top closing joining said end and side walls in a first fold line;

e) said top closing, when opened extending above the top edge of the side and end walls when said housing is positioned on its bottom;

f) said top closing including a transverse fold line extending generally parallel to said first fold line and located between said first fold line and the top edge of said housing;

g) said top closing including additional fold lines angled from the intersection of the upper corners of said side and end walls whereby said top closing may be folded:

to partially close said housing and display at least part of said motor oil container; and subsequently to close said housing; and whereby said top closing may extend upwards above the side and end walls of said housing to provide a splash guard when said housing when empty and resting on its bottom to receive waste oil from an engine; and means for securing said top closing in a closed position after filling with waste motor oil for transport and recycling.

9. The oil change kit in accordance with claim 8 wherein:

said container of new motor oil includes a pouring agent region which falls within the generally rectangular shape thereof; and at least one oil change accessory contained within said housing in the space adjacent to the pouring spout region of the motor oil container.

10. The oil change kit in accordance with claim 9 wherein said oil change accessory comprises a wipeup cloth.

11. The oil change kit in accordance with claim 9 wehrein said oil change accessory comprises at least one disposable glove.

12. The oil change kit in accordance with claim 9 wherein said oil change accessory comprises a wrench including a plurality of common crankcase plug head size receptacles whereby the drain plug of most automobile crankcases may be removed and replaced by the do-it-yourselfer.

* * * * *

UNITED STATES PATENT AND TRADEMARK OFFICE

CERTIFICATE OF CORRECTION

PATENT NO. : 5,092,457

DATED : 03/03/92

INVENTOR(S) : Steve Islava, et al.

It is certified that error appears in the above-identified patent and that said Letters Patent is hereby corrected as shown below:

Column 5, line 51, replace "container" with --containers--.

Column 8, line 4, replace "agent" with --spout--.

Column 8, line 13, replace "wehrein" with --wherein--.

Signed and Sealed this

Eighth Day of June, 1993

*Attest:*

Michael K. Kirk

MICHAEL K. KIRK

*Attesting Officer*

*Acting Commissioner of Patents and Trademarks*